US005493735A

United States Patent [19]

Rice

[11] Patent Number: 5,493,735

[45] Date of Patent: Feb. 27, 1996

[54] CAP WITH HAIR PIECE ATTACHMENTS

[76] Inventor: Judy Rice, 5031 Camp Bowie, Fort Worth, Tex. 76107

[21] Appl. No.: 228,559

[22] Filed: Apr. 15, 1994

[51] Int. Cl.[6] ..... A42B 1/24

[52] U.S. Cl. ..... 2/209.13; 2/174; 2/195.1; 2/209.14

[58] Field of Search ..... 2/171, 174, 181, 2/181.2, 181.4, 207, 209.13, 209.14, 422, 172, 175.1, 195.1, 195.7, 209.11, 209.12, 909, 918; 132/53, 54

[56] References Cited

U.S. PATENT DOCUMENTS

D. 273,341 4/1984 Rol .
D. 289,092 3/1987 Walker .
D. 289,093 3/1987 Walker .
2,651,310 9/1953 Selson ..... 2/207
5,170,509 12/1992 Leopold .
5,239,705 8/1993 Leopold .
5,337,763 8/1994 Haber et al. ..... 2/174

*Primary Examiner*—Diana Biefield
*Attorney, Agent, or Firm*—Charles D. Gunter, Jr.

[57] ABSTRACT

An apparel item is shown which includes a cap to be worn on a wearer's head. The cap interior has one or more specially designed fasteners for receiving mating fasteners of one or more hair accessory pieces, allowing the installation of such accessory pieces within the cap interior. The mating fasteners also include adjustment regions to vary the position and extent of exposure of the accessory hair pieces below the cap lower peripheral edge.

13 Claims, 3 Drawing Sheets

CAP WITH HAIR PIECE ATTACHMENTS

BACKGROUND OF THE INVENTION

1. Field of the Invention

The present invention relates generally to apparel items and, particularly, to a hat or protective head covering which has associated hair accessory pieces which can be removably and adjustably attached within the hat interior to simulate the appearance of human hair.

2. Description of the Prior Art

For many years, hats and caps of various styles, colors and shapes have been worn both as fashion apparel items and for protection. It is often desirable for women with short or unkept hair to wear a fashionable hat or cap which covers the head and at least partially covers the user's hair. Various hat designs are known which are intended to address such problems. One example is U.S. Pat. No. 5,239,705, issued Aug. 31, 1993, to Leopold which shows a fashionable cap which incorporates a hair piece located on the exterior of the back of the hat which simulates the appearance of a lengthy ponytail or braid. In addition to covering short or unkept hair, this design has features which are useful in other situations, such as where the wearer actively engages in physical or athletic activities and where the cap could become askew or dislodged from the user's head by such activity.

Another area of need exists for fashion apparel items of this same general class where the object is to provide a head covering which alleviates the problem of situation baldness. For example, many people are embarrassed by thinning hair or hair loss due to ageing, hereditary baldness patterns, or due to illness. There is a particular need for a head covering featuring adjustable and removable accessory hair pieces which simulate the appearance of human hair for use by chemotherapy patients who have lost some or all of their hair in the course of medical treatment.

Accordingly, it is an object of the present invention to provide a fashionable sports-type cap or hat which features one or more removable hair accessory pieces which realistically simulate the appearance of human hair.

Another object of the invention is to provide such a head covering which features both hair accessory pieces which simulate a ponytail or braid and other accessory pieces which simulate locks of hair on the sides of the head or front of the head.

Another object of the invention is to provide such an apparel item with interchangeable hair pieces which can be selectively removed or interchanged depending upon the style or occasion of use.

SUMMARY OF THE INVENTION

The apparel item of the invention includes a hat which is intended to be worn on a wearer's head, the hat having a crown, a front and a rear and having an initially open interior which is defined between the crown and a lower peripheral edge. The apparel item also includes at least one hair accessory piece which simulates the appearance of human hair. The hair accessory piece has an upper portion and a normally exposed lower portion. The upper portion includes a primary fastening means for removably installing the hair accessory piece within the initially open interior of the hat. At least one cooperating fastening means is located within the hat interior for matingly engaging the primary fastening means of the hair accessory piece. A selected one of the primary fastening means and the cooperating fastening means includes an adjustment region for varying the extent of exposure or relative position of the normally exposed lower portion of the hair accessory piece.

The hat can include a number of styles and can include, for example, a forwardly extending visor disposed at the front of the hat and means for adjusting the size of the hat to fit various head sizes.

Additional objects, features and advantages will be apparent in the written description which follows.

DETAILED DESCRIPTION OF THE INVENTION

Figure 1:
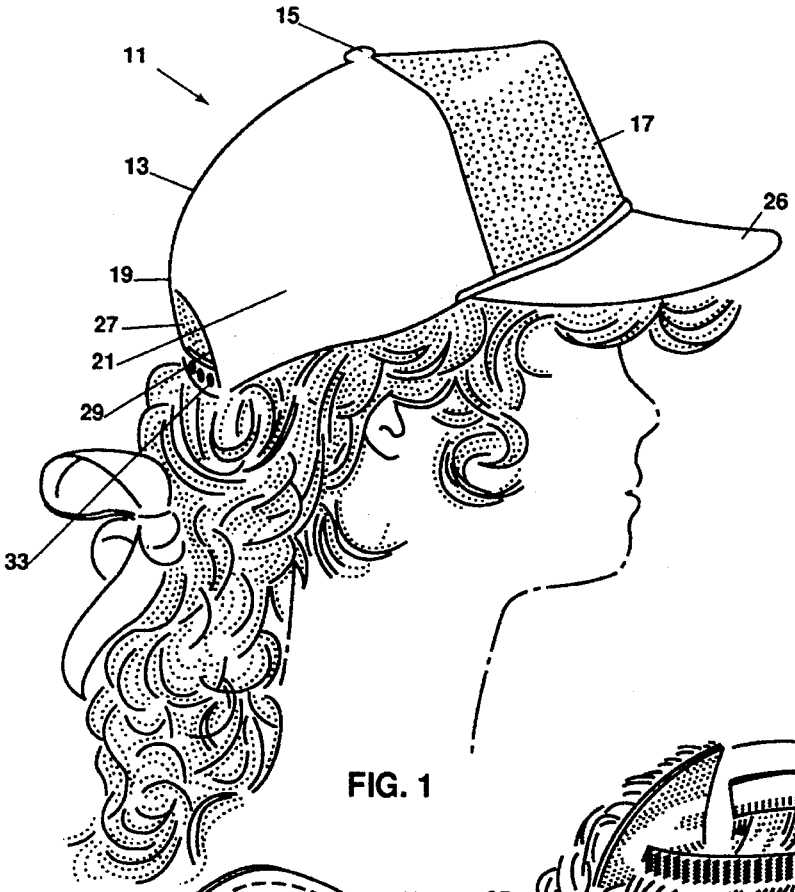
FIG. 1 is a side view of the apparel item of the invention showing the hat and associated hair accessory pieces thereof and showing a wearer's head in phantom lines.

FIG. 1 shows a hair apparel item of the invention designated generally as 11 in place on a wearer's head. The hair accessory item includes a protective head covering or cap 13 intended to be worn on a wearer's head. The protective head covering will be described in terms of a "hat" or "cap" with these terms being used interchangeably in the discussion which follows. The cap has a crown 15, a front 17, a rear 19 and opposing sides (side 21 shown).

Figure 2:
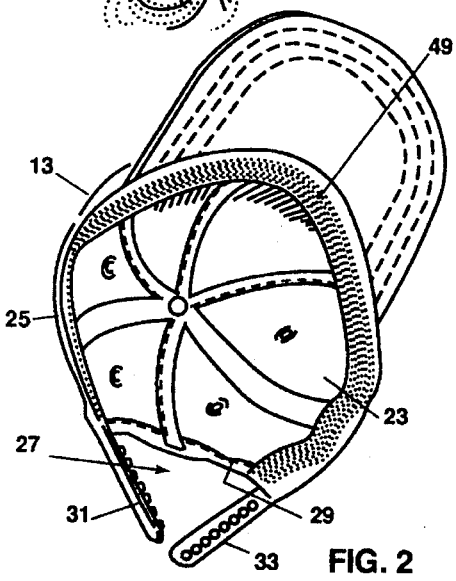
FIG. 2 is an isolated view of the interior of the hat of the invention showing the cooperating fastening means located within the interior thereof.

As shown in FIG. 2, the cap 13 has an initially open interior 23 which is defined between the crown 15 (FIG. 1) and a lower peripheral edge 25. As shown in FIG. 1, the cap 13 can also be provided with a forwardly extending visor 26 disposed at the front of the cap.

The cap of FIGS. 1 and 2 is of generally conventional design and may be constructed of any suitable material such as fabric, synthetic materials such as plastic, leather or a combination of such materials. The bill or visor 26 which extends forwardly from the front of the cap is generally relatively rigid and when worn occupies a position above the eyes of the wearer. However, the visor can be smaller or larger in length and can be omitted entirely.

The rear 19 of the cap 13 is provided with a cut-out portion 27 (FIGS. 1 and 2) which extends upwardly from the lower peripheral edge 25 and is defined by a seam or edge 29. An adjusting strap having connecting ends 31, 33 extends across the opening of the cut-out, generally aligned with the lower peripheral edge 25 when the connecting portions are joined. The strap allows the cap size to be adjusted so that the cap can be worn by individuals of different head sizes. The strap is of generally conventional design and can be of an elastic material or may be adjustable by other conventional means such as a buckle or a plurality of apertures in one strap end which register with connecting posts provided in the associated connecting strap end.

Figure 3:
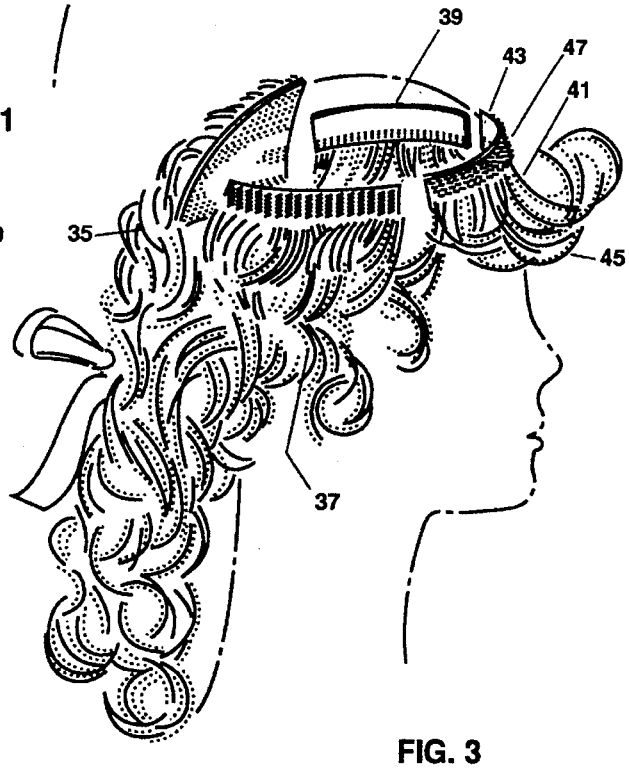
FIG. 3 is an isolated view of a plurality of hair accessory pieces which are intended to be engaged with the cooperating fastening means of the hat of FIG. 2, thereby allowing the extent of exposure of the normally exposed lower portion of the hair accessory pieces to be varied.

As shown in FIG. 3, the apparel item of the invention includes one or more hair accessory pieces 35, 37, 39, 41 which simulate the appearance of human hair. Each hair accessory piece, such as piece 41, has an upper portion 43 and a normally exposed lower portion 45 which is visible from beneath the peripheral edge 25 of the cap when the cap is in position on the wearer's head, as shown in FIG. 1. The accessory piece 41 also includes a primary fastening means 47 for removably installing the hair accessory piece within the initially open interior 23 of the cap. The primary fastening means 47 can be any means which is selectively engagable with a cooperating fastening means located within the cap interior to allow removal of the hair accessory piece of adjustment of the position or exposed extent thereof. In the examples illustrated, the primary fastening means 47 includes a region of hook and loop-type fastener material in the form of a strip arranged in a generally horizontal plane, as viewed in FIG. 3. For example, the fastening means can comprise a VELCRO hook or mating loop strip.

At least one cooperating fastening means, such as the mating VELCRO strip 49 (FIG. 2) is located within the cap interior running along the lower peripheral edge thereof within the cap interior. The cooperating fastening means is used to matingly engage the primary fastening means of the hair accessory piece.

Figure 4:
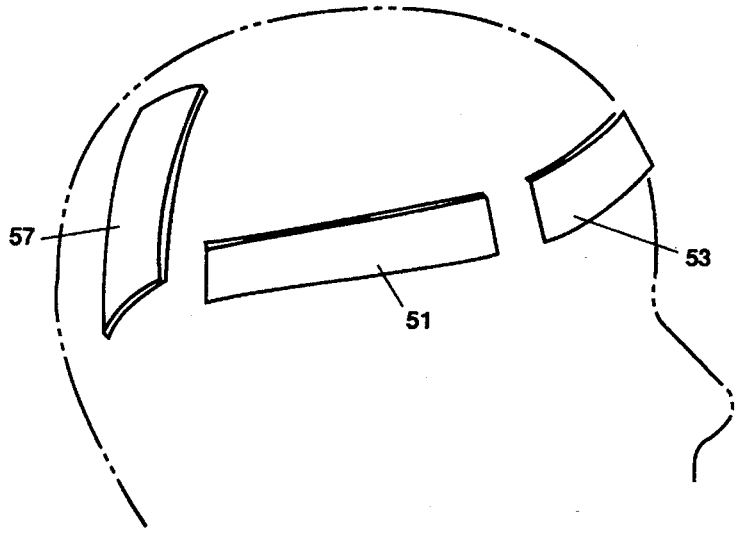
FIG. 4 is an isolated side view of the cooperating fastening means of the hat of FIG. 2 showing the relative position thereof on a wearer's head, indicated in phantom lines.
Figure 6:
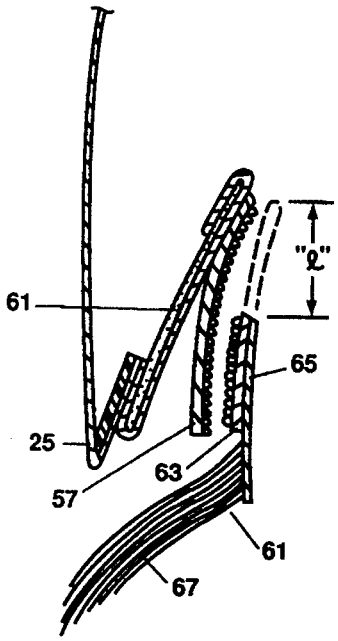
FIG. 6 is an isolated, expanded view of a portion of the hat interior illustrating the cooperating fastening means of the hair accessory pieces of the invention.
Figure 5:
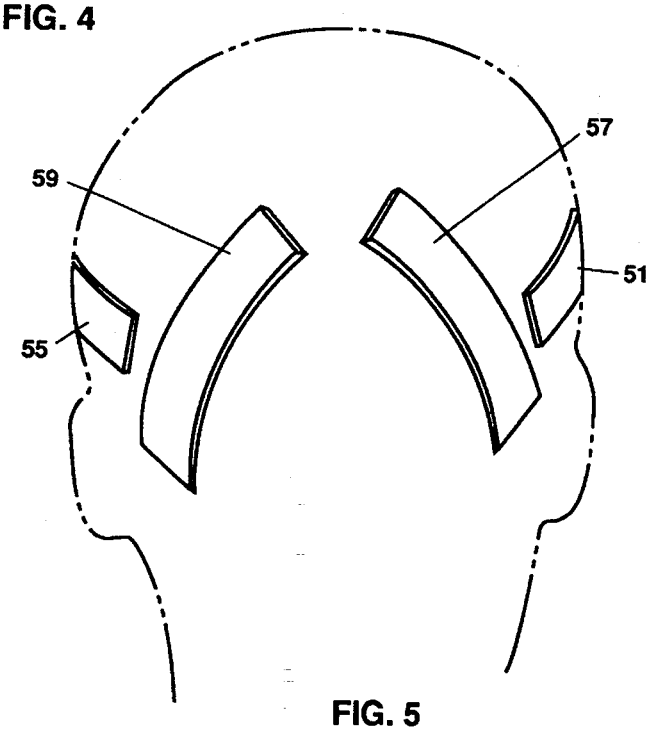
FIG. 5 is a rear view similar to the side view of FIG. 4 but taken from the back of the wearer's head, illustrating the cooperating fastening means of the hat of FIG. 2.

As illustrated in the drawings, a selected one of the primary fastening means 47 and the cooperating fastening means 49 includes an adjustment region for varying the position or extent of exposure of the normally exposed lower portion 45 of the hair accessory piece 41. This can be accomplished, as shown in FIGS. 4–6, by providing one or more horizontal fastening strips 51, 53, 55 within the cap interior which run along the interior peripheral edge thereof and/or by providing one or more generally vertically oriented strips 57, 59 which extend from the peripheral edge upwardly in the direction of the hat crown. FIGS. 4 and 5 are intended to schematically illustrate the positioning of the fastening strips within the cap interior if the hat (not shown) were in place on the wearer's head. The strips can be continuous, such as strips 49 in FIG. 2, or spaced apart at convenient intervals, such as strips 51, 53, 55 in FIGS. 4 and 5.

FIG. 6 is an exploded view of the cap lower peripheral edge 25 showing a conventional cushion ring or sweat band 61 including both an inner and outer synthetic layer to which has been sewn one of the vertically oriented strips 57. The strip 57 has been pulled partly away from the ring 61 for ease of illustration. The vertically oriented strip 57 includes an outer surface provided with a plurality of hooks for engaging mating loops provided on the hair accessory piece 61. The accessory piece 61 also includes inner and outer plies 63, 65, the outer ply 65 having attached thereto the material which simulates the appearance of human hair 67. The hair material 67 can be any of a variety of materials, either natural or synthetic, including human hair, fabrics, plastic such as polyethylene and polypropylene, rayon, nylon, and the like.

As shown in FIG. 6, the mating fastening region provided on the inner ply 63 of the hair accessory piece 61 can be positioned in a variety of vertical positions on the mating vertically oriented strip 57 to allow a length of adjustment, illustrated as "1" in FIG. 6. By positioning the accessory strip at various locations along the mating vertical strip, the extent of exposure or position of the simulated hair 67 can be varied. Similarly, the horizontally oriented strips 51, 53, 55 allow the relative position and, to some extent, exposure length of the hair piece to be varied within the cap interior. For example, the horizontally oriented strips 51, 53, 55 allow the hair pieces to be moved toward or away from the hat front 17 or rear 19.

In a preferred form of the invention, the apparel item includes hair accessory pieces which are removably secured on the front, back and opposing side regions of the cap interior, as shown in FIGS. 1 and 3. However, one advantage of the invention is the endless range of hair piece combinations which can be utilized, depending upon the fashion occasion.

Figure 7:
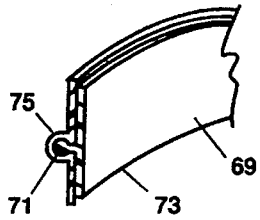
FIG. 7 is a partial, isolated view of another cooperating fastening means useful with the hair accessory pieces and hat of the invention.

FIG. 7 shows another fastening means which can be used to attach the hair pieces within the cap interior. In using this fastening means, a selected first strip such as strip 69 would carry the associated hair (not shown) and would be equipped with an external bead 71 running parallel to the lower edge 73 thereof. The mating connecting means would be mounted within the cap interior and would include a mating groove 75 for receiving the bead 71 in press-fit fashion. The strips could conveniently be formed of a plastic material, such as polyethylene.

Figure 8:
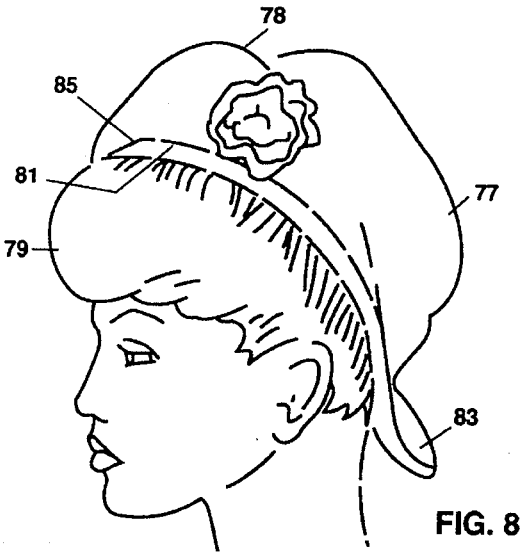
FIG. 8 is a side view of another hat and accessory item of the invention, the cooperating fastening means of the hat being shown in dotted lines.

FIG. 8 shows another style of hat 77 which features an associated hair accessory piece 79. The hat 77 has a crown 78, a recessed front region 81 and a downwardly extending rearward portion 83 which extends in the direction of the neck of the wearer. The recessed front region 81 exposes more of the peak 85 of the hair piece 79 than did the hat designs of FIGS. 1 and 2.

Figure 10:
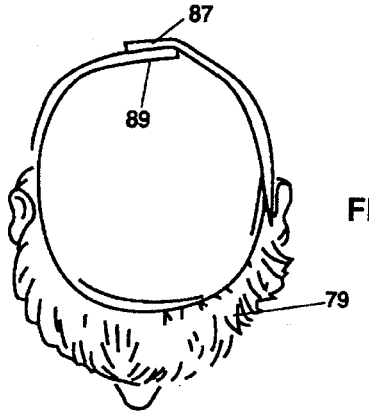
FIG. 10 is a top view of the hair accessory piece of FIG. 9 showing the rear fastening means thereof.
Figure 9:
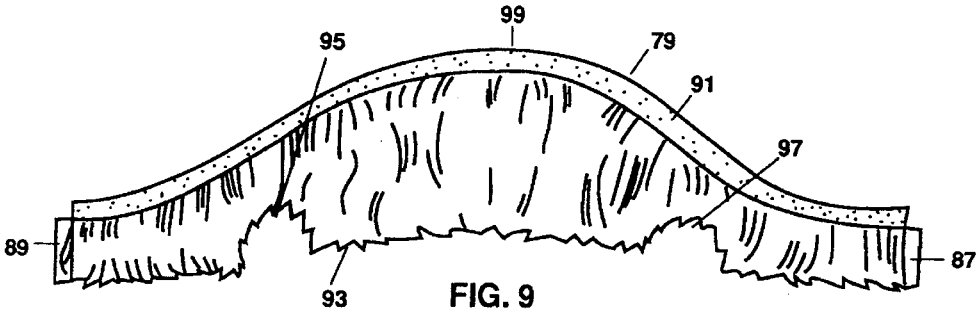
FIG. 9 is an isolated, planar view of the hair accessory piece used with the hat of FIG. 8.

The associated hair piece 79 shown in FIG. 9 is of one piece and has fastening means 87, 89 at the outer extents thereof which can be of the previously described VELCRO hook and loop type cooperating fasteners. The fastening means 87, 89 allow the opposite extents of the hair piece to be joined to form a loop which encircles the wearer's head, as shown in FIGS. 8 and 10. The hair piece also has a longitudinal strip 91 running along an upper peripheral edge thereof of primary fastening material for engaging cooperating strips of fastening material (not shown) within the hat interior in a manner identical to that previously described with reference to FIGS. 1–7. The primary fastening material in strip 91 provides a smooth top edge for the hair piece 79 while the bottom edge 93 is feathered to simulate human hair. A pair of ear openings 95, 97 are provided in the hair piece located approximately equi-distant from a center line 99 which accommodate the ears of the wearer in use.

Figure 12:
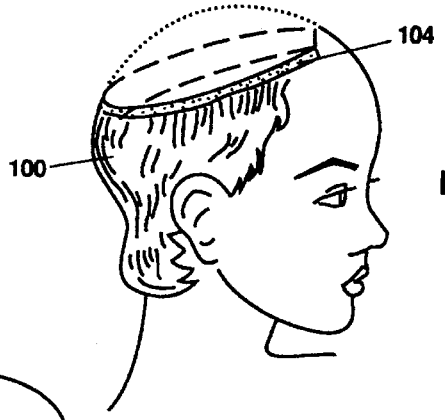
FIG. 12 is a side view of a hair accessory piece intended to be used with the hat of FIG. 11 shown in relative position on a wearer's head with the hat removed for ease of illustration.
Figure 11:
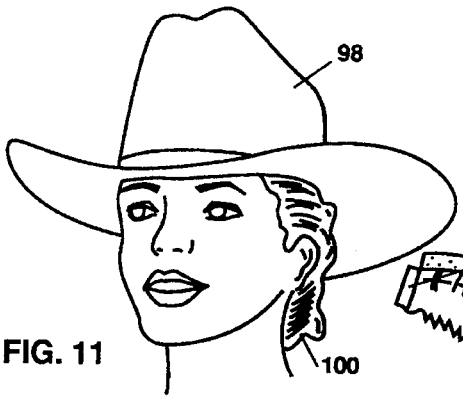
FIG. 11 is a perspective view of another hat and accessory item of the invention.
Figure 13:
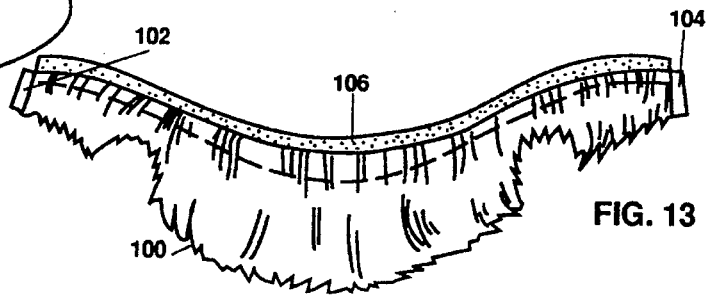
FIG. 13 is an isolated, planar view of the hair accessory piece used with the hat of FIG. 11.

FIG. 11 shows a western style hat 98 having an associated hair piece 100 of the invention. As shown in FIGS. 12 and 13, the hair piece 100 has fastening means 102, 104 and a longitudinal strip 106 for engaging cooperating fastening means within the hat interior, similar to hair piece 79.

In using the apparel item of the invention, a cap or hat is provided with a crown, a front and a rear and an initially open interior defined between the crown and a lower peripheral edge. One or more hair accessory pieces are provided for use with the cap, the accessory pieces simulating the appearance of human hair. Each accessory piece would have an upper portion and a normally exposed lower portion with the upper portions thereof including a primary fastening means for removably installing the hair accessory piece within the initially open interior of the cap. At least one cooperating fastening means would be provided within the cap interior for matingly engaging the primary fastening means. A selected one of the primary fastening means and the cooperating fastening means would include an adjustment region for varying the extent of exposure of the normally exposed lower portion of the hair accessory piece or for varying the relative position thereof within the cap interior. The position or extent of exposure of the lower portion of each hair accessory could then be adjusted by varying the position of engagement of the primary and secondary fastening means on the so provided adjustment regions thereof.

An invention has been provided with several advantages. The apparel item of the invention is relatively simple in design and inexpensive to manufacture. A variety of styles, shapes and designs of head coverings can be utilized and are easily adapted to receive the cooperating hair accessory pieces. The adjustable cap band allows one size cap to fit any number of wearer's having various head sizes. The adjustable fastening means allows various accessory hair pieces to be utilized, interchanged or removed. The adjustable region of the cooperating fastening means allows the position or relative exposure extent of each hair accessory piece to be customized to the particular wearer's head. Any type or style of hair can be utilized including colored hair, ethnic hair, rock hair, and the like.

While the invention has been shown in only one of its forms, it is not thus limited but is susceptible to various changes and modifications without departing from the spirit thereof.

What is claimed is:

1. An apparel item comprising:

a cap intended to be worn on a wearer's head, the cap having a crown, a front and a rear and having an initially open interior which is defined between the crown and a lower peripheral edge;

a hair accessory piece which simulates the appearance of human hair, the hair accessory piece having an upper portion and a normally exposed lower portion, the upper portion including a primary fastening means for removably installing the hair accessory piece within the initially open interior of the cap;

cooperating fastening means located within the cap interior for matingly engaging the primary fastening means of the hair accessory piece, a selected one of the primary fastening means and the cooperating fastening means including an adjustment region for varying the extent of exposure of the normally exposed lower portion of the hair accessory piece; and wherein the adjustment region includes a first fastening strip having a length and a width and wherein the first fastening strip is installed within the interior of the cap and wherein the length of the first fastening strip runs from the approximate cap lower edge in the direction of the cap crown and at least a second cooperating fastening strip having a length and a width and wherein the second cooperating fastening strip is installed within the interior of the cap and wherein the length of the second fastening strip runs peripherally along at least a portion of the approximate cap lower edge.

2. The apparel item of claim 1, wherein the cap has a forwardly extending visor disposed at the front of the cap.

3. The apparel item of claim 1, wherein the cap includes means for adjusting the size of the cap to various head sizes.

4. The apparel item of claim 1, wherein the primary fastening means of the hair accessory piece includes a region of a hook and loop type fastener material and wherein the cooperating fastening means includes a mating region of hook and loop type fastener material.

5. The apparel item of claim 4, wherein the adjustment region of the apparel item comprises one or more strips of hook and loop type fastener which are installed within the interior of the cap.

6. The apparel item of claim 5, wherein the first fastening strip is a hook and loop type fastener and wherein the second cooperating fastening strip is a hook and loop type fastener.

7. The apparel item of claim 5, wherein the cap includes a cut out region in the back thereof and wherein the hair accessory piece includes a ponytail or braid which is matingly engaged within the interior of the cap by the mating fastening means and which covers the cut out region from the interior of the cap and extends downwardly therefrom.

8. The apparel item of claim 7, wherein at least one additional hair accessory piece is provided which engages the second strip of hook and loop type fastener which is installed within the interior of the cap and which runs peripherally along at least a portion of the approximate cap lower edge.

9. The apparel item of claim 8, wherein the cap includes hair accessory pieces which are removably secured on front, back and opposing side regions of the cap interior.

10. A method of installing a hair apparel item of the head of a wearer, the method comprising the steps of:

providing a cap intended to be worn on a wearer's head, the cap having a crown, a front and a rear and having an initially open interior which is defined between the crown and a lower peripheral edge;

providing a hair accessory piece for use with the cap which simulates the appearance of human hair, the hair accessory piece having an upper portion and a normally exposed lower portion, the upper portion including a primary fastening means for removably installing the hair accessory piece within the initially open interior of the cap;

providing cooperating fastening means located within the cap interior for matingly engaging the primary fastening means of the hair accessory piece, a selected one of the primary fastening means and the cooperating fastening means including an adjustment region for varying the extent of exposure of the normally exposed lower portion of the hair accessory piece, wherein the adjustment region includes a first fastening strip having a length and a width and wherein the first fastening strip is installed within the interior of the cap and wherein the length of the first fastening strip runs from the approximate cap lower edge in the direction of the cap crown and at least a second cooperating fastening strip having a length and a width and wherein the second cooperating fastening strip is installed within the interior of the cap and wherein the length of the second cooperating fastening strip runs peripherally along at least a portion of the approximate cap lower edge; and adjusting the exposure of the lower portion of the hair accessory piece by varying the position of engagement of the primary and secondary fastening means on the adjustment region to thereby adjust the extent of exposure of the normally exposed lower portion of the hair accessory piece both vertically and horizontally with respect to the cap lower peripheral edge.

11. The method of claim 10, wherein the first fastening strip is a hook and loop type fastener and wherein the second cooperating fastening strip is a hook and loop type fastener.

12. The method of claim 11, wherein a cut out region is provided in the back of the cap and wherein a ponytail or braid accessory piece is matingly engaged within the interior of the cap by the mating fastening means and which covers the cut out region from the interior of the cap and extends downwardly therefrom.

13. The method of claim 12, wherein at least one additional hair accessory piece is provided which engages the second strip of hook and loop type fastener which is installed within the interior of the cap and which runs peripherally along at least a portion of the approximate cap lower edge.

* * * * *